United States Patent [19]

Richard

[11] Patent Number: 4,694,622

[45] Date of Patent: Sep. 22, 1987

[54] CONCRETE STRUCTURAL ELEMENTS, PROCESS AND DEVICE FOR MANUFACTURING THESE ELEMENTS

[75] Inventor: Pierre Richard, Neuilly Sur Seine, France

[73] Assignee: Bouygues, Clamart, France

[21] Appl. No.: 759,446

[22] Filed: Jul. 26, 1985

[30] Foreign Application Priority Data

Jul. 27, 1984 [FR] France ..... 84 11988
Jul. 27, 1984 [FR] France ..... 84 11987

[51] Int. Cl.[4] ..... E04C 3/10

[52] U.S. Cl. ..... 52/223 R; 52/309.17; 52/227; 264/228

[58] Field of Search ..... 52/223 R, 223 L, 224, 52/227, 230; 264/228

[56] References Cited

U.S. PATENT DOCUMENTS 2,593,714 4/1952 Robinson ..... 52/DIG. 7
2,645,090 7/1953 Kinneman ..... 52/223 R
3,162,709 12/1964 Davidson ..... 52/224
3,177,902 4/1965 Rubenstein ..... 52/DIG. 7
3,953,629 4/1976 Wesch ..... 428/36
3,970,495 7/1976 Ashton ..... 428/222
4,202,718 5/1980 Mizutani ..... 156/171

FOREIGN PATENT DOCUMENTS 276771 12/1969 Austria ..... 52/224
2300209 7/1973 Fed. Rep. of Germany .
2484355 6/1980 France ..... 52/223
2535281 5/1984 France .

*Primary Examiner*—Henry E. Raduazo
*Attorney, Agent, or Firm*—Fleit, Jacobson, Cohn & Price

[57] ABSTRACT

Concrete; structural elements having a high permissible working load typically in the range of at least 50–100 MPa. The element includes a block of compressed concrete surrounded by a tubular hoop made of intercrossed wires. Such elements are useful for making beams, posts, cables and the like.

14 Claims, 6 Drawing Figures

FIG-1
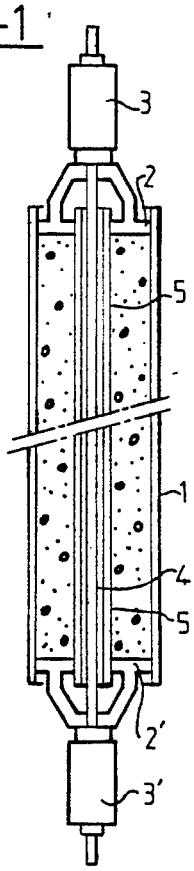
FIG-2
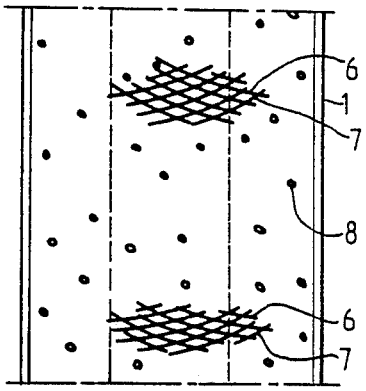
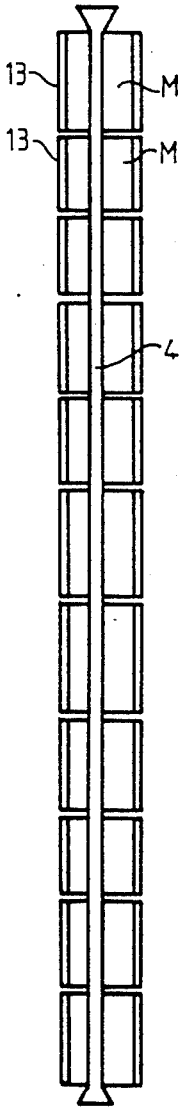
FIG-6
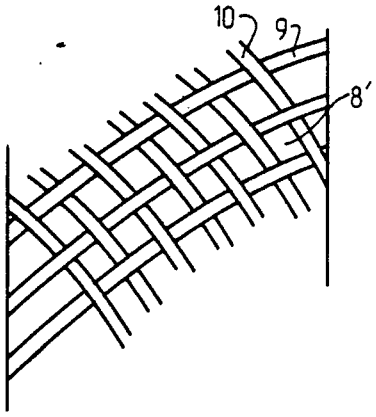
FIG-3
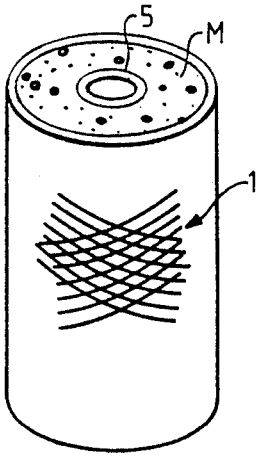
FIG-5
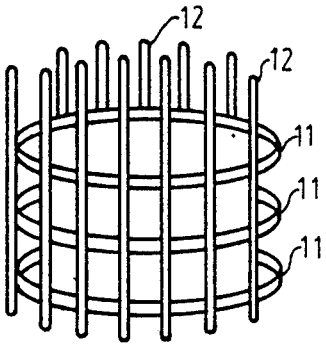
FIG-4

CONCRETE STRUCTURAL ELEMENTS, PROCESS AND DEVICE FOR MANUFACTURING THESE ELEMENTS

The invention relates to concrete structural elements having a high permissible working load, typically in the range of at least 50–100 MPa (megapascals).

BACKGROUND OF THE INVENTION

The U.S. Pat. No. 4,529,567 discloses a process for manufacturing such elements wherein the concrete is compressed axially before setting in a tubular casing surrounded by a hoop made of two windings having directions opposite to each other and fixed ends.

The casing and the hoop remain fixed to the concrete element and therefore it is very important that their cost be as low as possible.

SUMMARY OF THE INVENTION

According to the present invention, the hoop is a tube made of intercrossed wires which are mutually blocked at least at the ends of the tube.

Such loop and the casing may be manufactured together.

Two embodiments are particularly useful:

the hoop is made of webs embedded into a synthetic resin, the hoop together with the resin constituting the casing, the hoop is a woven product which constitute the hoop as well as the casing.

BRIEF DESCRIPTION OF THE DRAWINGS

The invention will be explained further hereafter with reference to the schematic figures of the attached drawing in which:

FIG. 1 is a longitudinal section through a device used for manufacturing a concrete element according to the invention;

FIG. 2 is an enlarged view of a portion of a hoop used according to the invention;

FIG. 3 is an enlarged view of another embodiment of hoop;

FIG. 4 is an enlarged view of a further embodiment of hoop;

FIG. 5 is a view of the element manufactured by means of the device according to FIG. 1, and FIG. 6 is a view of a concrete cable made of elements according to the invention.

DESCRIPTION OF THE PREFERRED EMBODIMENTS

The device shown in FIG. 1 comprises a tubular casing 1 to be filled up with concrete and means for axially compressing the concrete before the concrete sets.

Compressing means includes, for instance, two pressure plates 2,2' at ends of the casing and means for pushing or drawing the plates one towards the other one. The last means are, for instance one or two jacks 3,3'. In a simple embodiment, one of the pressure plates is fixed and the other one is movable and drawn or pushed towards the fixed plate. It is convenient to use a cable 4 for drawing the plates on towards the other one.

Preferably one or several longitudinal tubes 5 are provided in the concrete, for instance, for draining water from the concrete, for the passage of cable 4 or for other uses.

In an embodiment of the invention, the casing 1 is a tube made of crossed wire webs embedded into a cured synthetic resin. The resin is a means for blocking the wires of the webs. In FIG. 2 is shown a portion of such an embodiment wherein the hoop is made of two webs 6,7 or more which are crossed at about 90° to each other and which are helical windings whose winding directions are opposite.

Such a casing is easy to manufacute, for instance by using known processes for manufacturing plastics tube for high pressure (see, for instance French Patent No. 2 373 386).

Preferably during the manufacture, the wall of the casing is provided with holes 8 for draining the water from the concrete.

It is obvious that such a casing is by far less expensive than the device disclosed in the U.S. Pat. No. 4,529,567 which comprises a tube surrounded by a hoop spiral wire, which is itself surrounded by another hoop spiral wire.

Moreover the resin acts for protecting the webs against outside agents.

It is known to pour concrete in reinforced plastics casing (German Patent No. DE 2 300 209) but this prior art does not teach the use of a tubular casing, nor the use of a hoop, and does not teach compressing concrete.

In another embodiment, the hoop is a cylindrical fabric or braid. In FIG. 3 is shown a portion of such a hoop made of two bands 9,10 which are woven together in order to provide spirals whose winding directions are opposite and which are crossed at about 90°. The braid has windows 8' between the bands.

The bands are blocked relative to each other, at least at the ends of the tube, by adhesive means.

Such a hoop provides a double advantage: the hoop constitutes itself the casing and the windows constituted the draining holes. Thus, this embodiment appears to be still more advantageous than the embodiment disclosed above.

Each band may be made of two superposed ribbons. In such a case, at each crossing of the two bands, one-ribbon of a band passes between the two ribbons of the other band.

The invention is neither limited to a peculiar angle of crossing of the wires of the hoop, nor to a peculiar means (adhesive means, anchoring means, resin coating welding means . . . ) for blocking the wires of the hoop, and is not limited to the embodiments disclosed above.

Thus, in FIG. 4 is shown another embodiment wherein the hoop is a grid made of a set of annular wires 11 in superposed transverse planes crossed by longitudinal wires 12, the whole of the wires being blocked by a resin (not shown).

As wires for making the hoop, steel wires, glass wires or carbon wires are used preferably, for instance, wires having a diameter of 0.1 to 0.5 mm.

EXAMPLE

The hoop is a braid made of ribbons of carbon fibers having a width of about 5 mm and a thickness of about 0.1 mm. The windows in the hoop have a size of 4×4 mm and the interval between two adjacent windows (along a ribbon) is about 15 mm.

For manufacturing a concrete element, the casing is filled up with liquid concrete and the concrete is submitted to an axial pressure of at least 50 MPa before setting. The hoop stretches under the effect of compression and, when the concrete has set, it tries to resume its initial state, thereby exercising a compressing effect on the concrete in transverse planes.

An element obtained according to the invention comprises a block of compressed concrete surrounded by a tubular hoop made of inter crossed wires or webs such as described above.

For protecting the hoop, it is advisable to cover the hoop with a protecting sheath, even if the hoop is embedded in a hardened resin.

The concrete elements are useful as beams, posts and other rigid structural elements, and are particularly useful for making a concrete cable.

According to the invention, the cable (FIG. 6) comprises or is made of a line of elements according to the invention, the elements being assembled by one or more prestressing cables 4, which pass longitudinally through the elements (for instance, through tubes 5). Advantageously, such a prestressing cable is the cable used for compressing the concrete during the manufacture of the elements.

A cable made of several concrete elements is known (FR Patent Nos. 2 484 355 and 2 535 281) but the structure of the element and the way of assembling the elements are quite different from the teachings of the present invention.

The concrete elements may be separated by intermediate members or put end to end.

The prestressing cable may be made advantageously of carbon fibers embedded in a hardened synthetic resin.

Typically, the section of the concrete cable is 15 to 20 cm or more.

It is intended to obtain thereby cables having a length of several kilometers and made of elements having a length of about 10 to 15 meters.

Such cables are useful for replacing steel cables used for anchoring offshore platforms. Usually these cables are made of steel tubes having a diameter of about 40 to 60 cm and a wall thickness of about 2 to 3 cm, said tubes being assembled by welding or by mechanical means and rolled up on a drum.

The concrete cable according to the invention may have the same performance as the steel cable but the diameter and the weight of the concrete cable are substantially smaller, and the assembly is considerably simpler.

Further, since the concrete cable has a smaller diameter, the effect of the swell on the cable is substantially reduced. Moreover the concrete cable is less subject to corrosion.

I claim:

1. A block of uniformly compressed concrete formed by the steps of:

surrounding an area of liquid concrete with a hoop of resiliently stretchable wires crossing each other and passing between each other, compressing the liquid concrete to stretch the hoop, and allowing the liquid concrete to harden while under compression to thereby produce a block of concrete uniformly compresses by the force of the hoop returning to its pre-stretched condition.

2. A block of concrete according to claim 1 wherein the wires of the hoop include webs embedded into a synthetic resin.

3. A block of concrete according to claim 2 wherein the synthetic resin is set.

4. A block of concrete according to claim 2 wherein the webs include at least two helical windings whose winding directions are opposite.

5. A block of concrete according to claim 4 wherein said webs cross each other at about 90 degrees.

6. A block of concrete according to claim 1 wherein the wires of the hoop include a tubular braid.

7. A block of concrete according to claim 6 wherein the braid is made of bands which are woven together in order to provide spirals whose winding directions are opposite.

8. A block of concrete according to claim 7 wherein said bands cross each other at about 90 degrees.

9. A block of concrete according to claim 6 wherein each band comprises two superposed ribbons, one ribbon of a band passing between the two ribbons of another band at each crossing of the bands.

10. A block of concrete according to claim 6 wherein the bands are made of carbon fibers.

11. A block of concrete according to claim 1 wherein the hoop is surrounded by a protecting sheath.

12. A block of concrete according to claim 1 wherein the concrete block comprises at least one longitudinal passage.

13. A block of concrete according to claim 12 which is assembled in line with other such blocks of concrete so as to constitute a cable, the whole of the blocks being assembled by at least one common prestressing cable passing through passages of the blocks.

14. A block of concrete according to claim 13 wherein said prestressing cable is made of carbon fibers embedded into a hardened synthetic resin.

* * * * *